US005327619A

United States Patent [19]

Ortega

[11] Patent Number: 5,327,619

[45] Date of Patent: Jul. 12, 1994

[54] PLUNGER RELEASABLE LATCH

[76] Inventor: Victor A. Ortega, 3040 Beverly Rd., Camp Hill, Pa. 17011

[21] Appl. No.: 949,341

[22] Filed: Sep. 22, 1992

Related U.S. Application Data

[63] Continuation-in-part of Ser. No. 814,962, Dec. 26, 1991, abandoned.

[51] Int. Cl.[5] ..... A44B 11/00

[52] U.S. Cl. ..... 24/625; 24/616; 24/635

[58] Field of Search ..... 24/625, 615, 616, 617, 24/635, 629, 630, 313, 196, 573.1, 573.7

[56] References Cited

U.S. PATENT DOCUMENTS

| | | | |
|---|---|---|---|
| 684,497 | 10/1901 | Davies | 24/573.7 |
| 3,605,210 | 9/1971 | Lohr | 24/635 |
| 4,150,464 | 4/1979 | Tracy | 24/615 |
| 4,150,465 | 4/1979 | Tracy | 24/615 |
| 4,559,679 | 12/1985 | Downey | 24/615 |
| 4,688,337 | 8/1987 | Dillner et al. | 24/615 |
| 4,809,409 | 3/1989 | Van Riesen | 24/635 |
| 4,825,515 | 5/1989 | Wolterstorff, Jr. | 24/615 |
| 5,084,946 | 2/1992 | Lee | 24/615 |

FOREIGN PATENT DOCUMENTS

| | | | |
|---|---|---|---|
| 2635652 | 3/1990 | France | 24/615 |

OTHER PUBLICATIONS

Basics of Design Engineering, Machine Design, Jun. 1991, pp. 1075–1089.

*Primary Examiner*—Victor N. Sakran

[57] ABSTRACT

A fastener constructed of a receptacle enclosure shell (10), a frame structure (30) containing flexible beams (34, 35), and a plunger insert (50), is disclosed. The flexible beams (34, 35) contain transverse fins (36, 37) for releasably engaging internal salient ridges (16, 17) extending from within transverse walls (25, 26) of a main cavity (21) defined within receptacle enclosure shell (10) . The receptacle enclosure shell (10), also includes a notched end wall (14) for slidably retaining plunger insert (50). plunger insert (50) has forked fingers (52, 53) that are internally constrained within main cavity (21) of receptacle enclosure shell (10), and are directed towards transverse fins (36, 37) of flexible beams (34, 35), heretofore inserted into receptacle enclosure shell (10). plunger insert (50) also contains a slidable shaft (54) Which extends out through notched end wall (14) of receptacle enclosure shell (10), and at its outermost extremity, projects a boss (56). When an inwardly directed force is applied to boss (56), forked fingers (52, 53) of rigid plunger insert (50) contained within main cavity (21) of receptacle enclosure shell (10) ram transverse fins (36, 37) of flexible beams (34, 35) , causing the displacement of flexible beams (34, 35) , and the disengagement of transverse fins (36, 37) from internal salient ridges (16, 17) of receptacle enclosure shell (10), thereby releasing frame structure (30).

7 Claims, 6 Drawing Sheets

PLUNGER RELEASABLE LATCH

This application is a continuation-in-part of U.S. application Ser. No. 07/814,962, filed Dec. 26, 1991, now abandoned.

BACKGROUND OF THE INVENTION

1. Field of the Invention

This invention relates generally to mechanical fasteners, and specifically to an easily releasable slide action latch that can be applied to discreet objects to achieve disconnectable retention.

2. Description of the Prior Art

Mechanical latches represent a method of releasably engaging and holding or otherwise joining or assembling objects such as panels, enclosures, belts, fabric, or other similar, discreet objects. A wide variety of special-purpose fasteners are currently employed in the industry for quick-operating, repeated access applications.

As a specific example, to which no limitation is intended, currently in use for fastening chin-straps on to football helmets is a snap-ring, button type fastener. This widely used conventional fastener is fixed to a chin-strap by being threaded through two parallel slots on a rectangular frame and then typically contains a cylindrical grooved insert that's been riveted to a side of the rectangular frame. The grooved insert houses a retaining ring that is used to clasp the head of a peg or bolt previously fixed to the side of the helmet. Helmet chin-straps are first snapped on to one side of the helmet, passed along the jaw where it cups the wearer's chin, and then snapped on to the other side of the helmet. Typically constructed of heavy fabric, the straps will not tear or separate, even when subjected to high tensile loads.

While the simplicity of a snap-ring fastener design for chin-straps lends itself well to quick-application and release, it also tends to inadvertently "pop" open during high-impact collisions, a common occurrence in football. The snap-ring mechanism does not isolate external forces frequently generated by either a pull on the helmet chin-strap, or a direct or near impact to the snap-ring section. A tug on the loose end of the strap by another player's hand or arm, or a collision along the side of the helmet, can easily generate enough force to disengage the retention ring from the head of the peg. An unsecured helmet can then swivel uncontrollably about the wearer's head, creating a serious safety risk. Additionally, the head-on collisions common in American football, continuously generate impact forces within the face-guard bars fixed to the front face of a helmet. On a secure helmet, these impact forces are transferred to the shell of the helmet, and are ultimately absorbed by the player's head and neck, through a pull reaction produced by a properly fastened chin-strap. The front rim of the helmet, swiveling down and smacking the bridge of the nose, after a direct face-guard collision, is a painful, all too frequent consequence of a football helmet whose chin-strap fastener has inadvertently popped open. Evidence to the certainty of this problem can be seen by noting a centrally located rubber bumper along the front face of a majority of helmet's, representing an effort by manufacturer's to attenuate this common nose injury. Further evidence to the questionable reliability of a button type, snap-ring fastener mechanism, is noted by the prevalent trend toward use of helmet's containing double fasteners on each side, and frequent witnessing of a completely loose helmet rolling along the playing field after a particular aggressive scrimmage play.

Downey, under U.S. Pat. No. 4,559,679 (1985), attempts to introduce a more secure helmet strap fastener system. The reference patent discloses a complex to manufacture helmet fastener, whose disengagement consists of simultaneous, inwardly directed pressure into two opposing transverse openings of a unitary body member. This unitary body member, critical for operation, is not permanently secured to any other component, and could easily be removed from the scene. Manufacture of this unitary body member using conventional injection molding techniques would be very difficult, due to an arrangement requiring longitudinal and transverse openings in conjunction with flexible side latches. Designing deflection behavior for the first latching member so that it remains securely retained in the unitary body member, while a second latching member properly engages it, also poses significant engineering challenges.

Other alternative fasteners are depicted in U.S. Pat. Nos. 4,150,464 (1979), 4,809,409 (1989) and 684,497. Tracey, under U.S. Pat. No. 4,150,464 (1979), defines a buckle using a pair of opposing transverse locking slots in a system very similar to Downey. Release of the buckle also requires simultaneous inwardly directed pressure into two opposing transverse openings. Davies, under U.S. Pat. No. 684,497 (1901), illustrates a fastener using dual spring actuated hooks which engage internal projections on a stationary socket. Release of this system requires a similar, simultaneous inwardly directed lateral pressure along sides of the fasteners legs in order to compress a centrally placed spring. Van Riesen, under U.S. Pat. No. 4,809,409 (1989), describes a belt lock requiring a minimum of six pieces, containing a readily exposed transverse release mechanism. The plunger releasable latch fastener of this invention introduces a system requiring only one singular, simple yet reliable, longitudinal, in-line release action. Prior Art on a variety of quick-operating fasteners is referenced in Basics Design Engineering, Machine Design magazine, June 1991, pgs. 1075–1089. While obvious to those skilled in the art that some of the more rugged, complex latching mechanisms commonly available in the industry will withstand heavy impact applications, they are generally much more difficult to fasten and release.

In summary, review of Quick-Operating Mechanical fasteners heretofore known as prior art, does not readily disclose a system having combined attributes of:

a—reliable, high-impact mechanical shock resistance, b—design for simplicity of manufacture, and c—extreme ease of application and removal, in a manner that improves upon the noted limitations of button-type, snap-ring fasteners. Securing a chin-strap to a football helmet, being a specific example wherein one such type fastener is currently employed and noticeably found wanting.

OBJECTS AND ADVANTAGES

Accordingly, it is a general object of this invention to provide a new and improved latch in a manner that adequately addresses the aforementioned combined attributes.

Additional objects and advantages of the present invention also include:

a—To provide a disconnectable closure which requires only a simple, singular, unidirectional application of force to disengage.

b—To provide a disconnectable closure which requires only one flexing spring member.

c—To provide a disconnectable closure which requires a minimum of parts, and is of a design facilitating inexpensive manufacture.

d—To provide a disconnectable closure which reliably resists intense, direct mechanical impact.

e—To provide a disconnectable closure which can, within context of a specific embodiment, be applied to conventional football helmets without requiring any additional modification, due to being footprint compatible with snap-ring, button type fasteners in current use.

Other objects, features and advantages of this invention will be more readily appreciated upon consideration of accompanying detailed description and pertinent drawings.

LIST OF REFERENCE NUMERALS

10 Receptacle Enclosure Shell
12 End Slit Opening
14 Notched End Wall
16 Internal Salient Ridge
17 Internal Salient Ridge
18 Shield Wall
19 Internal Transverse Bearing Ledge
20 Internal Transverse Bearing Ledge
21 Main Cavity
22 Central Opening
23 Main Wall
24 Main Wall
25 Transverse Wall
26 Transverse Wall
27 Inwardly Sloping Surface
28 Inwardly Sloping Surface
29 Longitudinal Slotted Tab
30 Frame Structure
31 Flat Rectangular Section
32 Protruding Tab
34 Flexible Beam
35 Flexible Beam
36 Transverse Fin
37 Transverse Fin
38 Parallel Slot
39 Parallel Slot
40 Jagged Sawtooth Edge
41 Outwardly Sloping Surface
42 Outwardly Sloping Surface
43 Transverse Bearing Ledge
44 Transverse Bearing Ledge
45 Jagged Sawtooth Edge
50 Plunger Insert
52 Forked Finger
53 Forked Finger
54 Slidable Shaft
56 Boss
62 Stem
64 Counterbore
70 Peg Fastener
72 Main Component
74 Shell Flange
76 Shell Flange
78 Frame Flange
80 Hole
90 Strap
94 Belt
96 slot
98 slot 99 Protective Shroud

DETAILED DESCRIPTION OF THE PREFERRED EMBODIMENT

Figure 1:
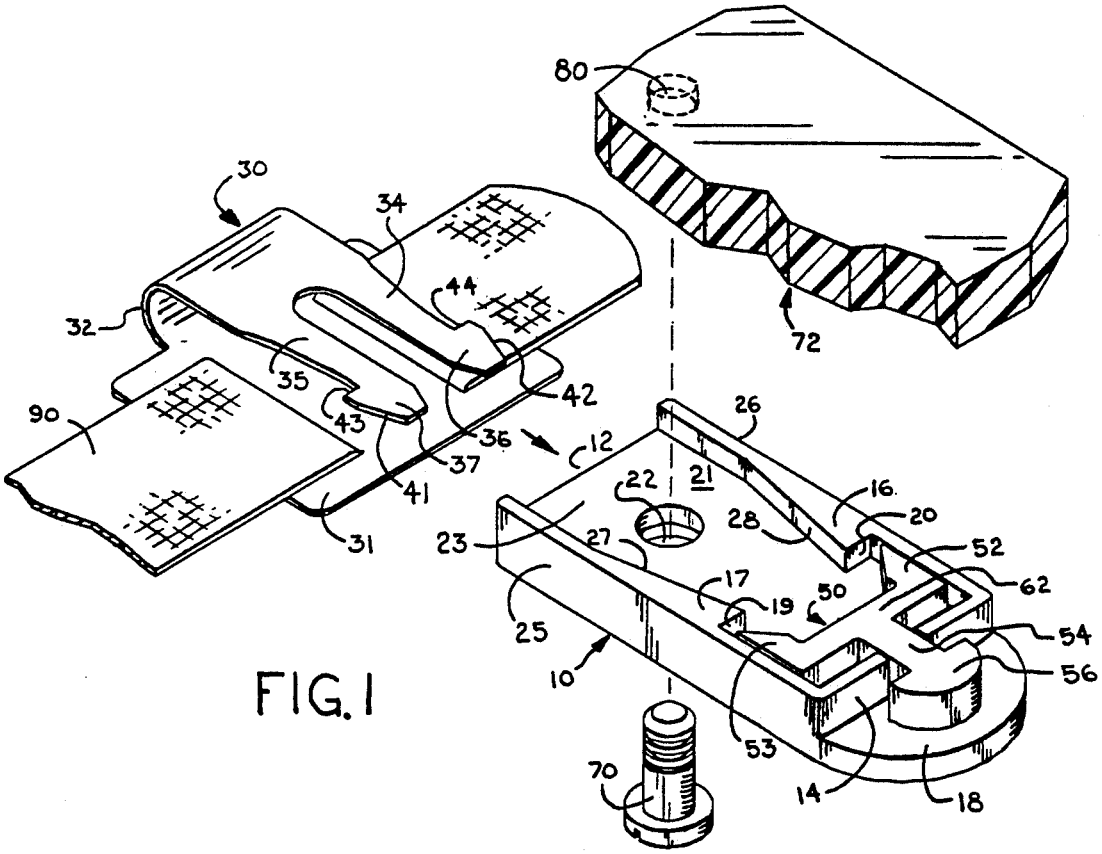
FIG. 1 depicts a perspective view displaying internal detail of invention in a disengaged condition, in combination with a strap and peg fastener.
Figure 2:
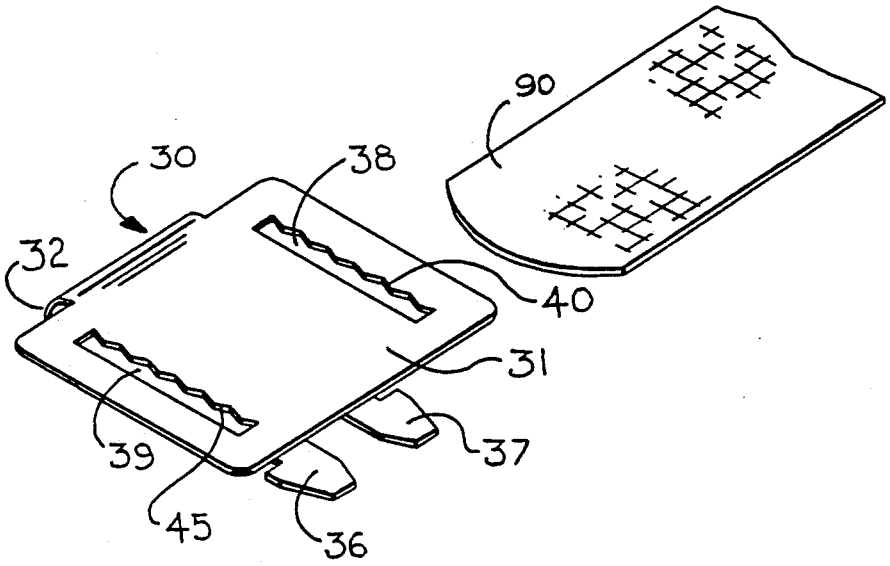
FIG. 2 depicts a close-up perspective view of parallel slots within a frame structure.
Figure 3:
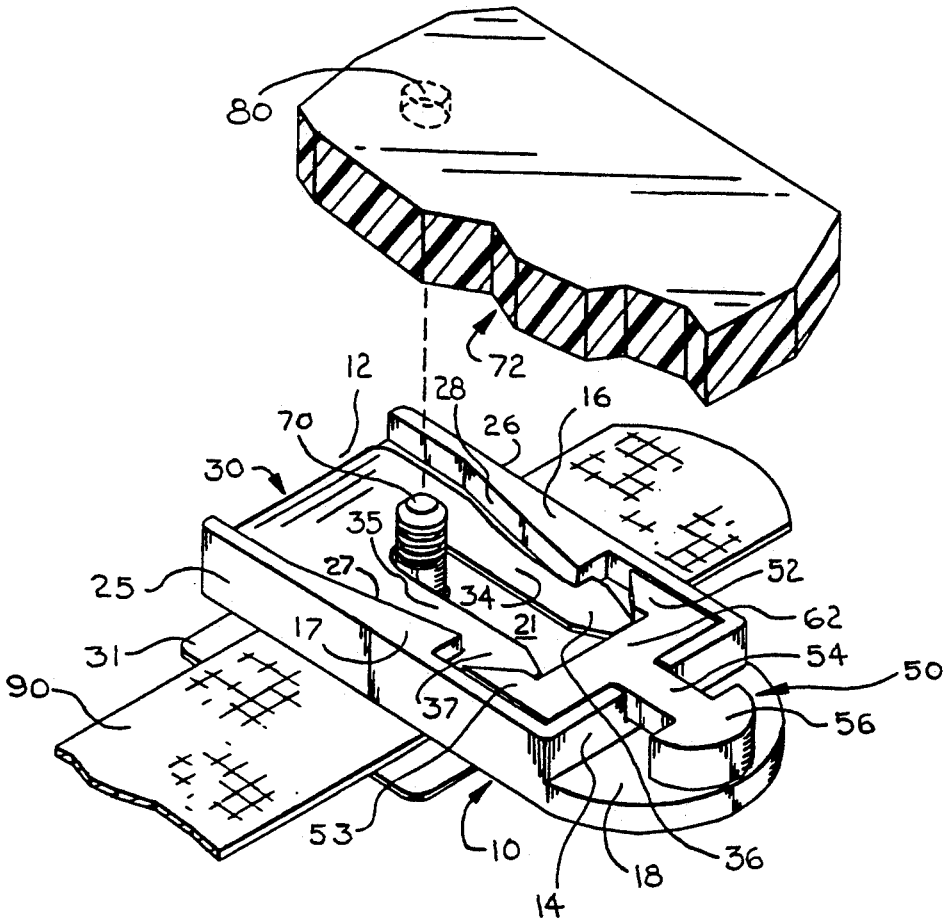
FIG. 3 depicts a perspective view displaying internal detail of invention in an engaged condition, in combination with a strap and peg fastener.
Figure 4:
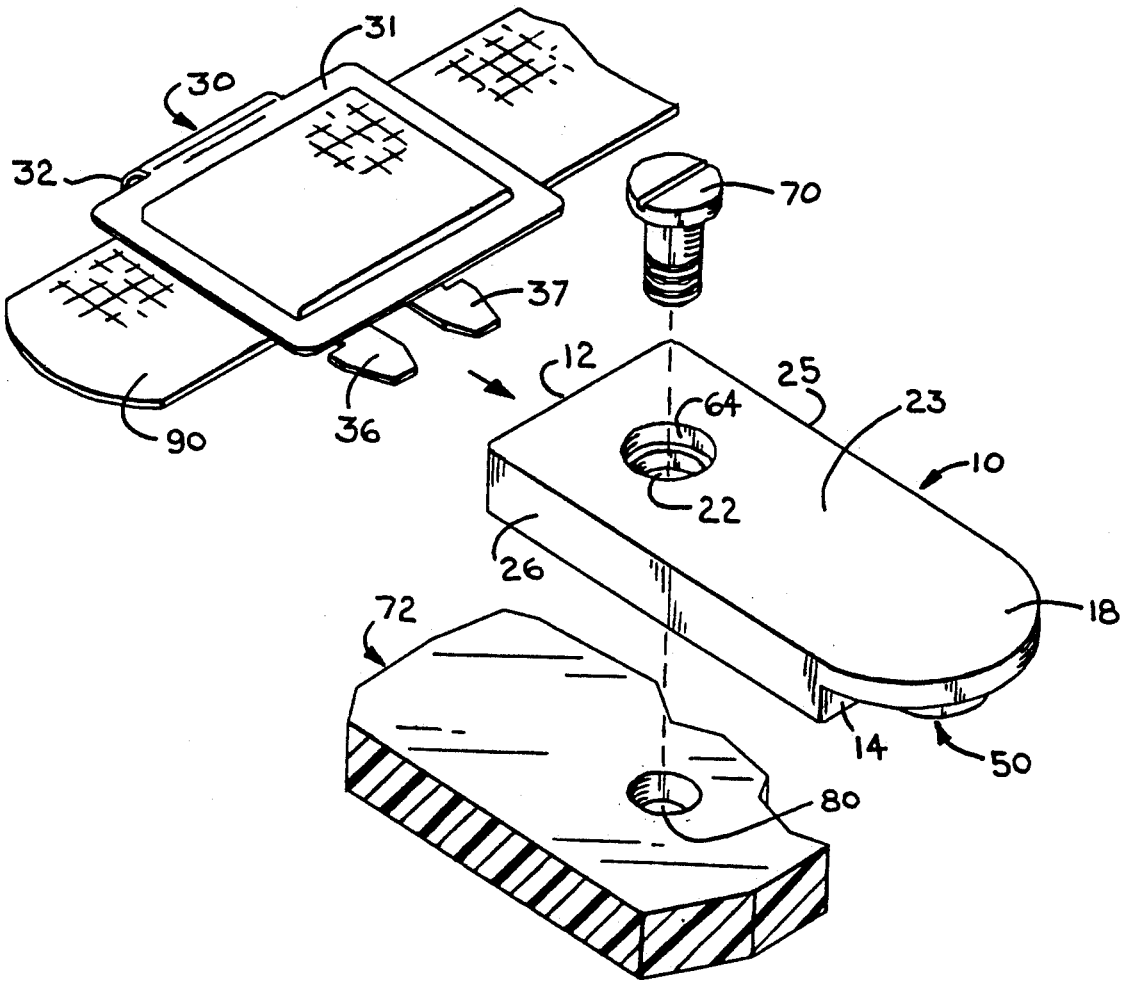
FIG. 4 depicts a perspective view displaying external detail of invention in a disengaged condition, in combination with a strap and peg fastener.

FIG. 1 depicts a helmet strap 90 whose tail end 92 is fixed to flat rectangular section 31 of frame structure 30. Flat rectangular section 31 of frame structure 30 is oriented longitudinally perpendicular to a reference alignment axis formed by flexible beams 34 and 35, receptacle enclosure shell 10, and rigid plunger insert 50. As shown in FIG. 2, parallel slots 38 and 39 are coextensive with each other, and constructed with the longitudinal side of each slot directed towards the center of strap 90 containing jagged sawtooth edges 40 and 45. Parallel slots 38 and 39 are also parallel to reference alignment axis formed by flexible beams 34 and 35, receptacle enclosure shell 10, and plunger insert 50. As illustrated in FIGS. 1, 3, 4, projecting from a side of flat frame section 31 oriented parallel to the lengthwise direction of helmet strap 90, and furthest from receptacle enclosure shell 10, is a curved protruding tab 32. This protruding tab 32, is formed to a semi-circular bend as depicted in FIG. 1. Linearly extending from curved protruding tab 32, are flexible beams 34 and 35, containing outwardly turned transverse fins 36 and 37 at the extremities. Outwardly turned transverse fins 36 and 37 are spaced apart by substantially the extent of end slit opening 12, lengthwise between the inside surfaces of transverse walls 25 and 26 of receptacle enclosure shell 10. The center space between flexible beams 34 and 35 is sized to allow passage past peg fastener 70, which is inserted through normal to the plane formed by projecting out the longitudinal surfaces of flexible beams 34 and 35. The lengths of flexible beams 34 and 35 are sized so that when fully inserted through end slit opening 12 in main cavity 21 of receptacle enclosure shell 10, transverse fins 36 and 37 extend longitudinally past the scope of internal salient ridges 16 and 17. The tips of transverse fins 36 and 37 define outwardly sloping surfaces 41 and 42 which diverge relative to the axis of symmetry defined by the geometry of flexible beams 34 and 35. Transverse fins 36 and 37 also contain transverse bearing ledges 43 and 44 which return from the outermost extremities of outwardly sloping surfaces 41 and 42 and face back towards end slit opening 12 of receptacle enclosure shell 10, when flexible beams 34 and 35 of frame structure 30 are inserted into end slit opening 12. The preferred construction material for the entire frame structure 30 is of a metal alloy having excellent tensile strength, fatigue strength, and formability characteristics. A stamping and forming operation of coiled strips of flat stock supplied from the metal alloy producer, is the preferred manufacture process for the frame structure 30.

FIG. 1 also illustrates receptacle enclosure shell 10 containing end slit opening 12 providing access to main cavity 21. Longitudinally opposite from end slit 12, is notched end wall 14. Aligned opposite each other and extending within main cavity 21, along transverse walls 26 and 27 of receptacle enclosure shell 10, are inwardly projecting internal salient ridges 16 and 17, spaced apart less than the lengthwise extent of end slit opening 12 in order to engage the outwardly projecting transverse fins 36 and 37 located on the tips of flexible beams 34 and 35. Internal salient ridges 16 and 17 are defined by inwardly sloping surfaces 27 and 28, which extend from the inside surfaces of transverse walls 25 and 26 and converge toward the central axis of symmetry within main cavity 21, and away from end slit opening 12. Further defining internal salient ridges 16 and 17 are internal transverse bearing ledges 19 and 20 which project perpendicular to the inside surface of transverse walls 25 and 26, and merge with the innermost extremities of inwardly sloping surfaces 27 and 28. A prerequisite for engagement, the gap defined between internal transverse bearing ledges 19 and 20, the inside surface of notched end wall 14, and transverse walls 25 and 26, must be sized to allow for the combined volume displacements of transverse fins 36 and 37 of frame structure 30, in conjunction with stem 62 and forked fingers 52 and 53 of plunger insert 50.

The preferred embodiment as depicted in FIGS. 1, 3, 4, also contains a central opening 20 located on main wall 23 of receptacle enclosure shell 10. This opening allows a peg fastener 70 to be inserted normal to main wall 23 which passes through the body of receptacle enclosure shell 10, between flexible beams 34 and 35 of frame structure 30, and joins with hole 80 of main component 72. As illustrated in FIG. 4, a counterbore 64 is located on the outside surface of main wall 23, sized to allow the head of peg fastener 70 to locate below the plane of the surface. The wall thickness of main wall 23 of receptacle enclosure shell 10, is less than the diameter formed by the semi-circular bend of protruding tab 32 extending from frame structure 30. Coplanar and longitudinally projecting from within main wall 23, along the bottom edge of notched end wall 14, is shield wall 18. An injection molded thermoplastic polymer having excellent toughness and physical shock resistance is the preferred construction material for the receptacle enclosure shell 10.

FIGS. 1, 3, 4, also show plunger insert 50 retained by notched end wall 14 of receptacle enclosure 10. plunger insert 50 is longitudinally aligned with receptacle enclosure shell 10, and flexible beams 34 and 35, and contains forked fingers 52 and 53 at one end and boss 56 at the other. Forked fingers 52 and 53 are connected to each other by stem 62. plunger insert 50 is assembled with receptacle enclosure 10 so that forked fingers 52 and 53 and stem 62 are constrained within main cavity 21, pointing towards the internal transverse bearing ledges 19 and 20 inside main cavity 21. Slidable shaft 54 extends out from the center of stem 62 through notched end wall 14. The Outer transverse edges of of forked fingers 52 and 53 are sized to slidably fit within internal surfaces of transverse walls 25 and 26 of receptacle enclosure shell 10. At its outermost longitudinal extremity, slidable shaft 54 projects boss 56. An injection molded thermoplastic polymer having excellent rigidity and corrosion resistance, is the preferred construction material for the plunger insert 50.

Figure 5:
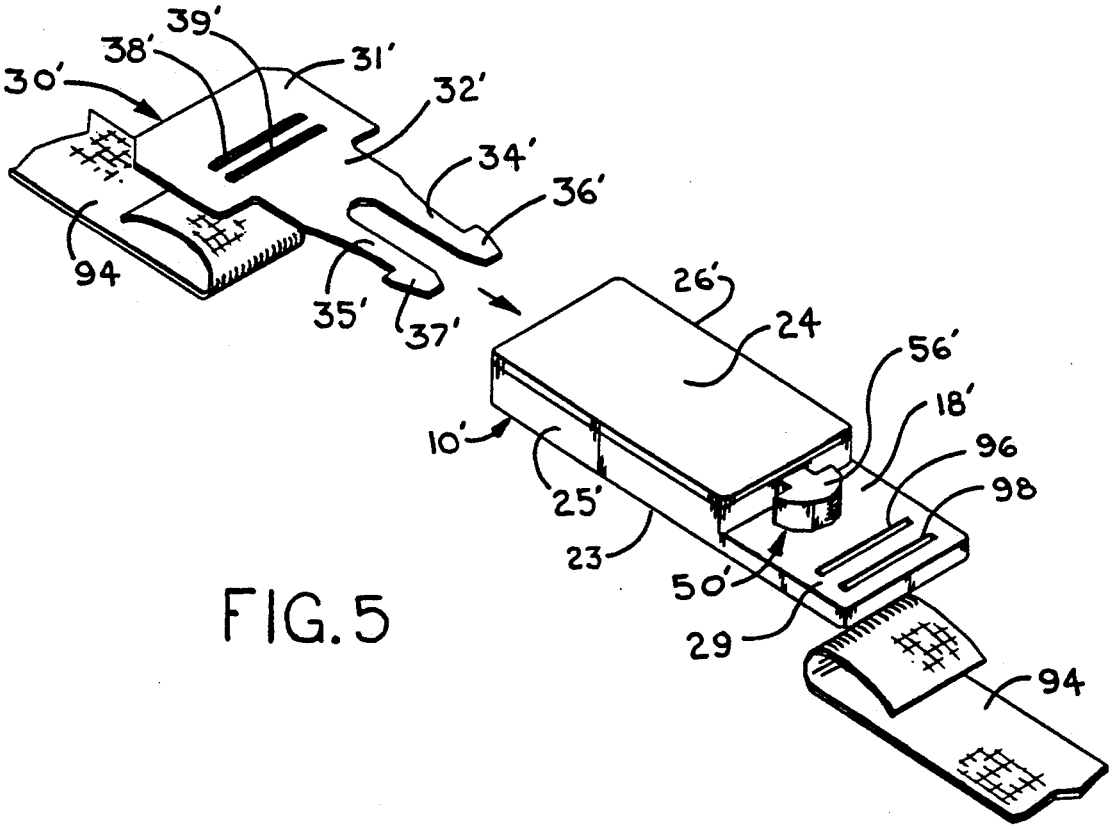
FIG. 5 depicts a perspective view displaying external detail of invention in a disengaged condition, in combination with two belts.
Figure 7:
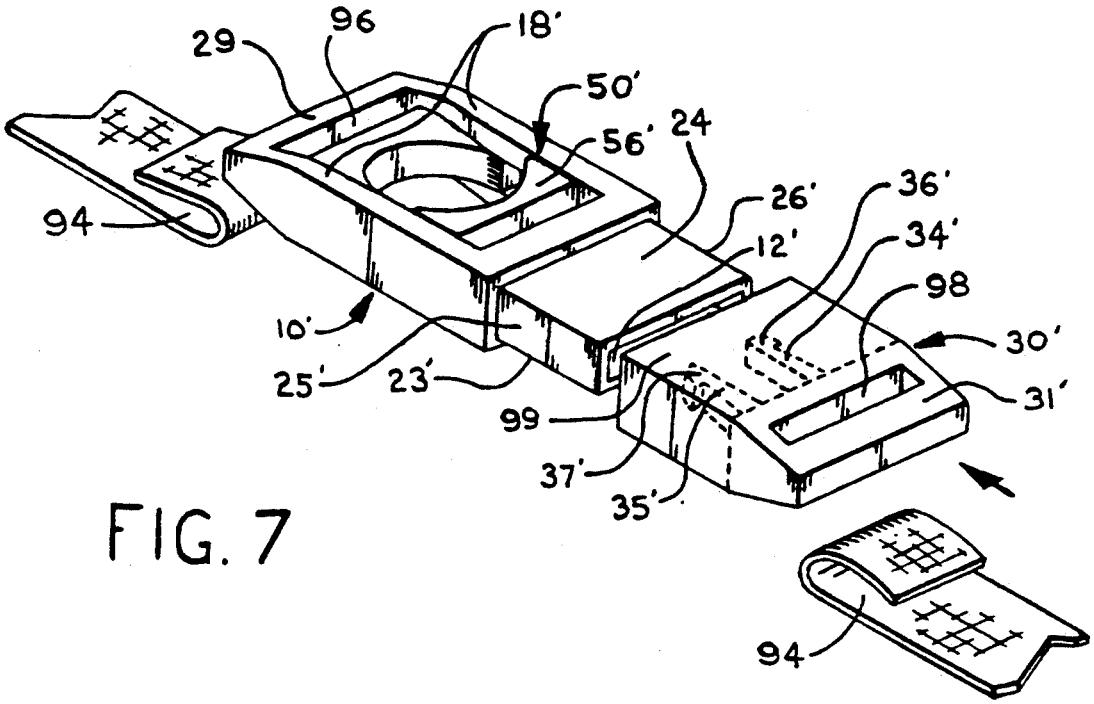
FIG. 7 depicts a perspective view displaying external detail of invention in a disengaged condition, in combination with two belts and illustrating use of a protective shroud.

FIG. 5 and FIG. 7 depict an external view of an alternative embodiment of the invention. The functional equivalent parts of this embodiment are indicated by primed numbers corresponding to their unprimed equivalents in the embodiments of FIGS. 1–4. Additional parts not previously mentioned in this detailed description, will not be assigned the prime number designation. Receptacle enclosure shell 10' in FIG. 7 contains a slotted tab 29 which extends out from shield walls 18'. A belt 94 is looped through slotted tab 29 and secured in a conventional manner. Receptacle enclosure shell 10' of FIG. 5 further includes a main wall 24 which is parallel and coextensive with main wall 23'.

Frame structure 30' in FIG. 7 also illustrates protective shroud 99, which extends out longitudinally from the body of rectangular section 31' and surrounds flexible beams 34' and 35'. Flexible beams 34' and 35' contain transverse fins 36' and 37' at extremities. Flat rectangular section 31' also contains slot 98 that allows belt 94 to loop through. Belt 94 is then secured in a conventional manner.

Figure 6:
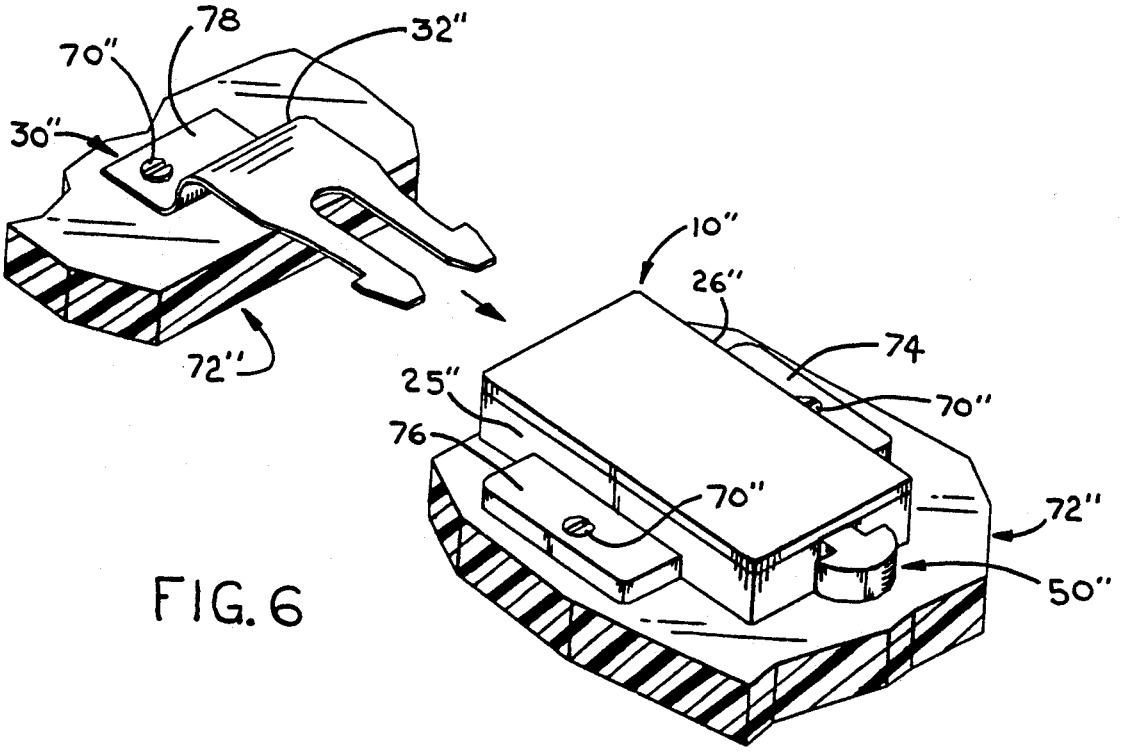
FIG. 6 depicts a perspective view displaying external detail of invention in a disengaged condition, in combination with flanges.

FIG. 6 depicts another alternative embodiment of the invention using shell flanges 74 and 76 and frame flange 78. The functional equivalent parts of this embodiment are indicated by doubly primed numbers corresponding to their unprimed equivalents in the preferred embodiment of FIGS. 1, 3, 4. The shell flanges 74 and 76 project outwardly from transverse walls 25'' and 26'' of receptacle enclosure shell 10'' and are fixed to main component 72'' by peg fasteners 70''. The flat, rectangularly shaped frame flange 78 longitudinally extends from protruding tab 32'' of frame structure 30'' and is fixed to main component 72'' by using peg fastener 70''. Projecting out from rectangularly shaped frame flange 78 towards end slit opening 12'' of receptacle enclosure frame 10'', is a protruding tab 32'' which extends into flexible beams 34'' and 35''. Flexible beams 34' and 35' contain transverse fins 36' and 37+ at the extremities.

Operation of Invention

Operation of the plunger releasable latch can be generally classified as a simple, push-to-open push-to-close action. Referring to FIG. 4 illustrating the preferred embodiment, receptacle enclosure shell 10 is first fixed to the hole 80 in main component 72 using peg fastener 70. Strap 90 is then secured to parallel slots 38 and 39 located on flat rectangular section 31 of frame structure 30. As detailed in FIG. 2, strap 90 is stitched through parallel slots 38 and 39 so that jagged sawtooth edges 40 and 45 are directed towards the center of strap 90. Once strap 90 is secured to frame structure 10, ends of flexible beams 34 and 35 containing transverse fins 36 and 37 are inserted into end slit opening 12 of frame structure 30. As transverse fins 36 and 37 of flexible beams 34 and 35 are further inserted into main cavity 21 of receptacle enclosure shell 10, leading edges of inwardly sloping surfaces 27 and 28 from internal salient ridges 16 and 17 of receptacle enclosure shell 10 slidably engage outwardly sloping surfaces 41 and 42 of transverse fins 36 and 37 of frame structure 30. As the insertion push continues, flexible beams 34 and 35 flex inward, towards each other. The insertion movement climaxes when the distance between outermost extremities of transverse bearing ledges 43 and 44 of flexible beams 34 and 35, is less than the distance between the innermost extremities of internal transverse bearing ledges 19 and 20 of receptacle enclosure shell 10, allowing the longitudinal penetration of transverse fins 36 and 37 past the full extent of internal salient ridges 16 and 17. Flexible beams 34 and 35 then spring back to their original configuration, locking the frame structure 30 to receptacle enclosure shell 10. FIG. 3 illustrates the preferred embodiment of the invention in a locked condition. Outside of receptacle enclosure shell 10, flat rectangular section 31 passes freely over the outside surface of main wall 23, maintaining a clearance gap defined by the diameter of the semi-circular bend of protruding tab 32, less the thickness of main wall 23.

In addition to locking with receptacle enclosure shell 10, the leading edges of transverse fins 36 and 37 of flexible beams 34 and 35, contact forked fingers 52 and 53 of plunger insert 50. This contact causes forked fingers 52 and 53 to longitudinally displace out from receptacle enclosure shell 10, until stem 62 contacts notched end wall 14, defining the limit of insertion. This displacement of forked fingers 52 and 53 causes an outward movement of slidably shaft 54 and the external projection of boss 56. Cover shield 18, extending from main wall 23 of receptacle enclosure shell 10, protects projecting boss 56 from inadvertent impact. Receptacle enclosure shell 10, made of impact resistant thermoplastic, isolates the locked flexible beams 34 and 35 from physical shock, leaving only flat rectangular section 31 of frame structure 10 exposed. In stark contrast to the aforementioned snap-ring fastener design, the majority of impacts to the strap fastener area can now be absorbed through receptacle enclosure shell 10, and ultimately transferred to main component 72. Flexible beams 34 and 35 made of a very high-strength metal alloy, and optimally designed for resilient spring behavior using state-of the art mechanical analysis technology, will easily surpass the overall mechanical retention performance of a conventional retaining-ring, snap-on type, fastener.

Disengagement of a plunger releasable latch is simple and efficient. An push from an external source on boss 56 which projects from receptacle enclosure shell 10, concurrently rams the tips of forked fingers 52 and 53 located within main cavity 21 onto outwardly sloping surfaces 41 and 42 of transverse fins 36 and 37. This pressure on transverse fins 36 and 37 causes the inward flex of flexible beams 34 and 35, until the shortestmost distance defined by the outermost extremities of outwardly sloping surfaces 41 and 42, is less than the shortestmost distance defined by the innermost extremities, of inwardly sloping surfaces 27 and 28. When this clearance occurs as the release push action continues, transverse fins 36 and 37 disengage internal salient ridges 16 and 17 of flexible beams 34 and 35, allowing flexible beams 34 and 35 to slide out of main cavity 21 through end slit opening 12. The limit of the releasing push displacement action is defined when the tips of forked fingers 52 and 53 of plunger insert 50 contact the internal transverse bearing ledges 19 and 20 of receptacle enclosure shell 10.

The operation of the invention in alternative embodiments as depicted in FIGS. 5, 7, is analogous to the method just described. The intent here is to demonstrate alternative ways of configuring the invention, such as within two surfaces of main components, or straps or belts.

SUMMARY, RAMIFICATIONS AND SCOPE

Accordingly, the reader will note that the plunger-releasable latch of this invention can be used to provide a mechanical fastener system with desirable qualities such as disconnectable retention, reliability, ease of manufacture, impact resistance, and an ease of application, that significantly improves upon the prior art. Also accordingly, it will be easily apparent to those skilled in the art that the essence of the invention can be incorporated into a variety of systems. Although not described in any of the specified embodiments, either of the engaging members can be fixed to a surface of an object using adhesive compounds, or be incorporated into fabric materials by sewing or riveting a flange or tab section extending from the engaging members.

Therefore, the foregoing description of the preferred embodiment of the invention has been presented for the purposes of illustration and description. It is not intended to be exhaustive or to limit the invention to the precise embodiments disclosed. Many modifications and variations are possible in light of the above teaching. It is intended that the scope of the invention be limited not by this detailed description, but rather by the claims appended hereto.

What is claimed is:

1. A latch system which comprises:

a—a receptacle enclosure shell having a means for attachment to a support structure, with an end slit opening and a longitudinally opposite notched end wall, both providing access into a main cavity within said receptacle enclosure shell which contains transversely aligned, inwardly directed, rigid internal ridges with inwardly sloped leading edges terminated by transverse bearing ledges, and b—a u-shaped frame structure having a pair of parallel legs joined by a semi-circular bend portion, one of said legs having a plurality of spaced apart parallel slots each of said slots having a jagged sawtooth edge, defining a strap receiving belt end attachment means buckle-type and the other leg, containing a protruding tab that extends out to form a pair of integral flexible beams spaced apart a set distance and projecting transverse fins flanked by outwardly sloped surfaces, whereby said transverse fins displace inwardly towards each other during insertion into said receptacle enclosure shell due to contact with said inwardly sloped leading edges of said rigid internal ridges, thereafter engaging said transverse bearing ledges within said main cavity of said receptacle enclosure shell, and c—a plunger insert containing forked fingers projecting out from a stem support structure at one end, and connected to a slidable shaft that extends out to form a boss section at its longitudinal opposite end, said plunger insert positioned within said receptacle enclosure shell whereby said forked fingers are slideably contained in a lengthwise manner, their tips directed towards said rigid internal ridges inside said main cavity of said receptacle enclosure shell, and said slideable shaft passes through said notched end wall of said receptacle enclosure shell projecting out said boss section, whereupon said plunger insert, when pushed inward by a longitudinally directed external force applied at said boss section causes said forked fingers to slide in a lengthwise direction and impact said outwardly sloped surfaces of said transverse fins projecting from said integral flexible beams, causing an inward displacement of said transverse fins towards each other until they disengage from said transverse bearing ledges of said main cavity, and thereafter, within the same lengthwise in-line motion, said forked fingers displace said transverse fins out towards said end slit opening, thereby releasing said u-shaped frame structure from said receptacle enclosure shell.

2. The latch system of claim 1 wherein said receptacle enclosure shell further includes a central opening allowing insertion of peg fastener, said peg fastener providing means for securing said receptacle enclosure shell to said support structure.

3. The latch system of claim 1 wherein said receptacle enclosure shell further includes construction of molded plastic material.

4. The latch system of claim 1 wherein said support structure is further defined as a helmet.

5. The latch system of claim 1 wherein said receptacle enclosure shell further includes mounting flanges providing means for securing said receptacle enclosure shell to said support structure.

6. The latch system of claim 1 wherein said receptacle enclosure shell further includes adhesive coated external surfaces providing means for securing said receptacle enclosure shell to said support structure.

7. A latch system which comprises:

a—a receptacle enclosure shell with longitudinally aligned transverse shield walls extending out lengthwise, said shield walls connected at their longitudinal end by a slotted tab, with a belt secured around said slotted tab, said receptacle enclosure shell having an end slit opening and a longitudinally opposite notched end wall, both providing access into a main cavity within said receptacle enclosure shell which contains transversely aligned, inwardly directed, rigid internal ridges with inwardly sloped leading edges terminated by transverse bearing ledges, and b—a frame structure defining a strap receiving belt end attachment means buckle-type and the other leg, containing a protruding tab that extends out to form a pair of integral flexible beams spaced apart a set distance and projecting transverse fins flanked by outwardly sloped surfaces, said flexible beams enclosed by a protective shroud, whereby said transverse fins displace inwardly towards each other during insertion into said receptacle enclosure shell due to contact with said inwardly sloped leading edges of said rigid internal ridges, thereafter engaging said transverse bearing ledges within said main cavity of said receptacle enclosure shell, and c—a plunger insert containing forked fingers projecting out from a stem support structure at one end, and connected to a slidable shaft that extends out to form a boss section at its longitudinal opposite end, said plunger insert positioned within said receptacle enclosure shell whereby said forked fingers are slideably contained in a lengthwise manner, their tips directed towards said rigid internal ridges inside said main cavity of said receptacle enclosure shell, and said slideable shaft passes through said notched end wall of said receptacle enclosure shell projecting out said boss section, whereupon said plunger insert, when pushed inward by a longitudinally directed external force applied at said boss section causes said forked fingers to slide in a lengthwise direction and impact said outwardly sloped surfaces of said transverse fins projecting from said integral flexible beams, causing an inward displacement of said transverse fins toward each other until they disengage from said transverse bearing ledges of said main cavity, and thereafter, within the same lengthwise in-line motion, said forked fingers displace said transverse fins out towards said end slit opening, thereby releasing said frame structure from said receptacle enclosure shell.

* * * * *